US008336510B2

(12) United States Patent
Asahi et al.

(10) Patent No.: US 8,336,510 B2
(45) Date of Patent: Dec. 25, 2012

(54) VALVE TIMING CONTROL APPARATUS

(75) Inventors: Takeo Asahi, Kariya (JP); Shigemitsu Suzuki, Takahama (JP); Masaki Kobayashi, Okazaki (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 332 days.

(21) Appl. No.: 12/724,686

(22) Filed: Mar. 16, 2010

(65) Prior Publication Data

US 2010/0242883 A1 Sep. 30, 2010

(30) Foreign Application Priority Data

Mar. 25, 2009 (JP) ..... 2009-074113

(51) Int. Cl.
*F01L 1/34* (2006.01)

(52) U.S. Cl. ..... 123/90.15; 123/90.17

(58) Field of Classification Search ..... 123/90.15, 123/90.17; 91/45, 448
See application file for complete search history.

(56) References Cited

U.S. PATENT DOCUMENTS

| | | | | |
|---|---|---|---|---|
| 5,901,674 | A * | 5/1999 | Fujiwaki | 123/90.17 |
| 6,035,819 | A * | 3/2000 | Nakayoshi et al. | 123/90.17 |
| 6,408,807 | B1 | 6/2002 | Komazawa et al. | |
| 6,532,922 | B2 | 3/2003 | Komazawa | |
| 7,198,014 | B2 * | 4/2007 | Kanada et al. | 123/90.17 |
| 7,513,227 | B1 | 4/2009 | Ogawa et al. | |
| 2007/0107684 | A1 * | 5/2007 | Takahashi et al. | 123/90.17 |
| 2007/0266976 | A1 * | 11/2007 | Nagashima | 123/90.17 |

FOREIGN PATENT DOCUMENTS

| | | | |
|---|---|---|---|
| DE | 10 2006 059 656 | A1 | 7/2007 |
| EP | 0 857 859 | A1 | 8/1998 |
| EP | 2 157 291 | A1 | 2/2010 |
| JP | 10-220207 | A | 8/1998 |

OTHER PUBLICATIONS

European Search Report issued Jun. 21, 2010 by the European Patent Office in European Patent Application No. 10 00 2318.

* cited by examiner

*Primary Examiner* — Thomas Denion
*Assistant Examiner* — Steven D Shipe
(74) *Attorney, Agent, or Firm* — Buchanan Ingersoll & Rooney PC

(57) ABSTRACT

A valve timing control apparatus includes an inner rotor, a vane, an outer rotor, a first fluid passage to an advanced angle chamber, a second fluid passage to a retarded angle chamber, a lock mechanism restricting the relative rotation between the inner and outer rotors, a third fluid passage establishing an unlocked state by supplying the fluid to the lock mechanism and a locked state by discharging the fluid from the lock mechanism, a first switching valve supplying the fluid to each of the first and second fluid passages and discharging from each of the first and second fluid passages and a second switching valve controlling a fluid flow to be supplied to or discharged from the third fluid passage, wherein the first switching valve is operated independently from the second switching valve, and the fluid is supplied to the first switching valve via the second switching valve.

8 Claims, 8 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2009-074113, filed on Mar. 25, 2009, the entire content of which is incorporated herein by reference.

TECHNICAL FIELD

A present invention relates to a valve timing control apparatus used at a valve train of an internal combustion engine for controlling an opening and closing timing of each of intake and exhaust valves of the internal combustion engine.

BACKGROUND DISCUSSION

A known valve timing control apparatus disclosed in JPH10-220207 includes a rotation transmitting member to which rotational power is transmitted from a crankshaft pulley and mounted on a rotational shaft portion for opening and closing a valve so as to be relatively rotatable within a predetermined range, a vane attached to the rotational shaft portion configured by a camshaft and an inner rotor provided integrally with the camshaft, an operating chamber defined by the rotational shaft portion and the rotation transmitting member and divided into an advanced angle chamber and a retarded angle chamber by the vane, a first fluid passage formed in fluid communication with the advanced angle chamber for supplying and discharging a fluid therein and therefrom, respectively, a second fluid passage formed in fluid communication with the retarded angle chamber for supplying and discharging the fluid therein and therefrom, respectively, a retracting bore formed at the rotation transmitting member for housing a locking pin being biased by a spring toward the rotational shaft portion, a receiving bore formed at the rotational shaft portion and into which a head portion of the locking pin is inserted when a relative phase between the rotational shaft portion and the rotation transmitting member is synchronized to a predetermined phase and a third fluid passage formed in fluid communication with the receiving bore for supplying and discharging the fluid therein and therefrom.

According to the valve timing control apparatus disclosed in H10-220207, the fluid communication through the third fluid passage is established independently from the fluid communication through each of the first fluid passage and the second fluid passage.

In the foregoing structure, because the fluid communication through the third fluid passage is established independently from the fluid communication through each of the first fluid passage and the second fluid passage, for example, whenever the internal combustion engine is in operation, from its start to stoppage, but not at immediately after the start of the engine in which the rotation is unstable, the oil may be stably supplied in a continual manner to the receiving bore via the third fluid passage, and during the time period immediately after the start of the internal combustion engine and upon the stoppage thereof, the fluid can be drained from the receiving bore.

Thus, while the internal combustion engine is operated, but not immediately after the start of the internal combustion engine, the head portion of the locking pin can retract into the retracting bore after leaving the receiving bore and the locking pin can remain in the unlocked state. In addition, during the time immediately after the start of the internal combustion engine and upon the stoppage thereof, the head portion of the locking pin is inserted into the receiving bore for maintaining the locking condition.

However, when the internal combustion engine is stopped, a position of the locking pin may not correspond to a position of the receiving bore. In this case, the locking pin may be moved so as to be inserted into the receiving bore by use of small oscillating movements of the camshaft caused by torque fluctuation. According to the valve timing control apparatus in H10-220207, a switching valve for supplying/discharging the fluid to/from the third fluid passage and a control valve for supplying/discharging the fluid to/from the first fluid passage and the second fluid passage are arranged so as to be parallel to the pump, and the fluid is supplied to the first fluid passage or the second fluid passage at the time of the start of the internal combustion engine, and then the chambers are filled with the fluid so that the small oscillating movements of the camshaft may not occur, accordingly the locking pin may not be inserted into the receiving bore.

A need thus exists to provide a valve timing control apparatus which is not susceptible to the drawback mentioned above.

SUMMARY

According to an aspect of this disclosure, a valve timing control apparatus includes an inner rotor rotating integrally with a camshaft for opening and closing a valve of an internal combustion engine, a vane attached to the inner rotor, an outer rotor mounted to the inner rotor so as to be relative rotatable therewith in a predetermined range and being rotated by a rotational force transmitted from a crankshaft of the internal combustion engine, a fluid pressure chamber formed at an inner portion of the outer rotor and divided into an advanced angle chamber and a retarded angle chamber by the vane, a first fluid passage formed in fluid communication with the advanced angle chamber, a second fluid passage formed in fluid communication with the retarded angle chamber, a lock mechanism used for restricting a relative rotation between the inner rotor and the outer rotor, a third fluid passage formed in fluid communication with the lock mechanism to restrict the relative rotation between the inner rotor and the outer rotor by discharging the fluid from the lock mechanism and to allow the relative rotation between the inner rotor and the outer rotor by supplying the fluid to the lock mechanism, a first switching valve for controlling a fluid flow so as to be supplied to each of the first fluid passage and the second fluid passage and so as to be discharged from each of the first fluid passage and the second fluid passage and a second switching valve for controlling a fluid flow so as to be supplied to and discharged from the third fluid passage, wherein the first switching valve is operated independently from an operation of the second switching valve, and fluid is supplied to the first switching valve via the second switching valve.

According to another aspect of this disclosure, a valve timing control apparatus includes an inner rotor rotating integrally with a camshaft for opening and closing a valve of an internal combustion engine and including a vane attached thereto, a vane attached to the inner rotor, an outer rotor mounted to the inner rotor so as to be relative rotatable therewith in a predetermined range and being rotated by a rotational force transmitted from a crankshaft of the internal combustion engine, a fluid pressure chamber formed at an inner portion of the outer rotor and divided into an advanced angle chamber and a retarded angle chamber by the vane, a first fluid passage formed in fluid communication with the advanced angle chamber, a second fluid passage formed in fluid communication with the retarded angle chamber, a lock mechanism used for restricting a relative rotation between the inner rotor and the outer rotor, a third fluid passage formed in fluid communication with the lock mechanism to restrict the relative rotation between the inner rotor and the outer rotor by discharging the fluid from the lock mechanism and to allow the relative rotation between the inner rotor and the outer rotor by supplying the fluid to the lock mechanism, a first switching valve for controlling a fluid flow so as to be supplied to each of the first fluid passage and the second fluid passage and so as to be discharged from each of the first fluid passage and the second fluid passage, a second switching valve for controlling a fluid flow so as to be supplied to and discharged from the third fluid passage and a fluid pump for supplying fluid to the first switching valve and the second switching valve, wherein the first switching valve is operated independently from an operation of the second switching valve, and the second switching valve is provided between the fluid pump and the first switching valve.

According to further aspect of this disclosure, a valve timing control apparatus includes an inner rotor rotating integrally with a camshaft for opening and closing a valve of an internal combustion engine, an outer rotor mounted to the inner rotor so as to be relative rotatable therewith in a predetermined range and being rotated by a rotational force transmitted from a crankshaft of the internal combustion engine, an advanced angle chamber formed by the inner rotor and the outer rotor and used for displacing a rotational phase of the inner rotor relative to the outer rotor in an advanced angle direction by increasing a volume of the advanced angle chamber, a retarded angle chamber formed by the inner rotor and the outer rotor and used for displacing the rotational phase of the inner rotor relative to the outer rotor in a retarded angle direction by increasing the volume of the retarded angle chamber, a lock mechanism used for restricting the rotational phase of the inner rotor relative to the outer rotor at a predetermined phase between a most advanced angle phase and a most retarded angle phase, a first switching valve for controlling a fluid flow so as to be supplied to and discharged from the advanced angle chamber and the retarded angle chamber, a second switching valve for controlling a fluid flow so as to be supplied to and discharged from the lock mechanism and a fluid pump for supplying the fluid to the first switching valve and the second switching valve, wherein, when the second switching valve is not activated, the fluid is not supplied from the fluid pump to the first switching valve via the second switching valve.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments related to this disclosure will be explained in accordance with the attached drawings. Each embodiment has similar configuration that is indicated by identical numerals, and the similar configuration will not be repeated in each embodiment.

<First Embodiment>

Figure 1:
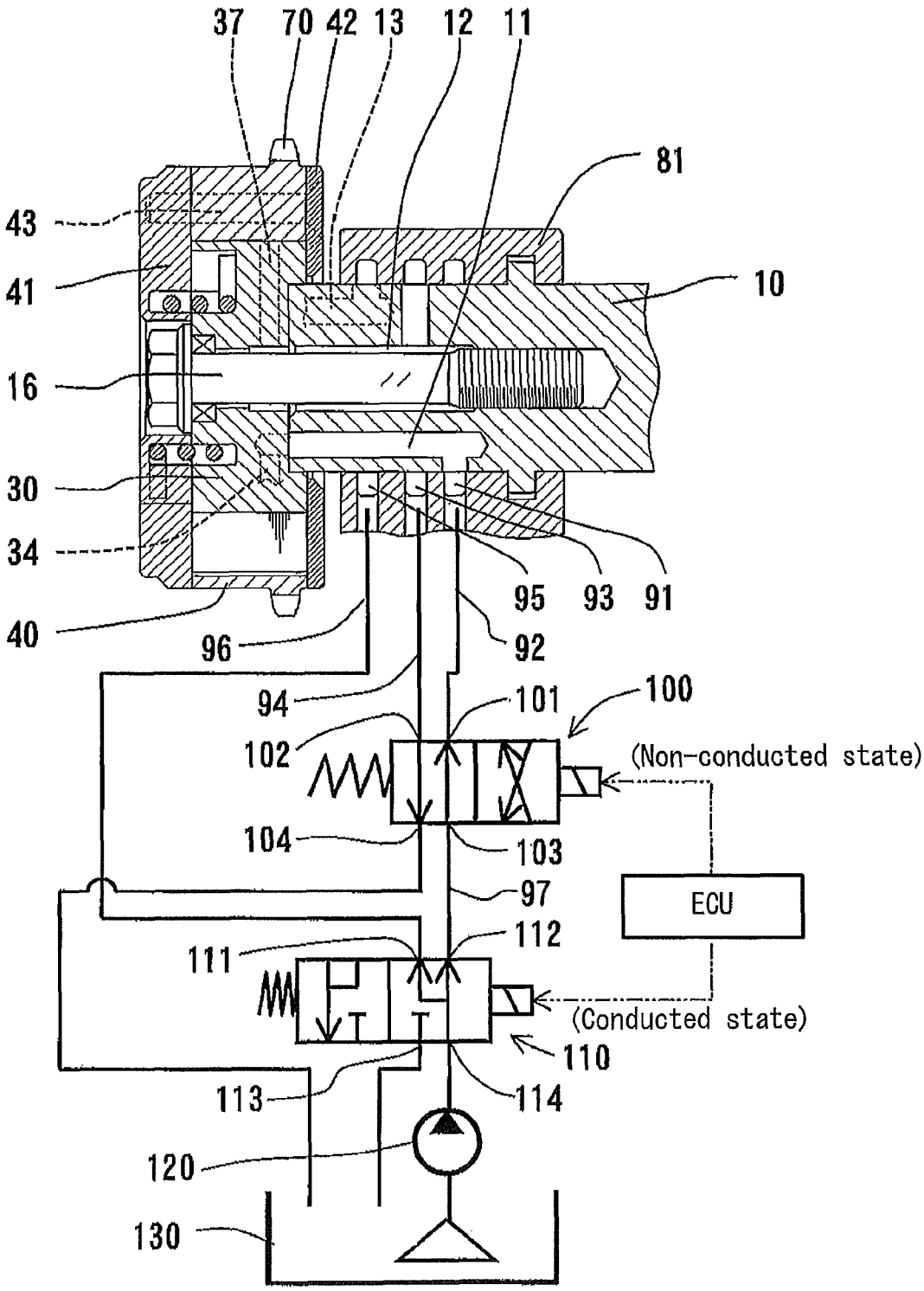
FIG. 1 illustrates an entire configuration diagram indicating a first embodiment of a valve timing control apparatus of this disclosure.
Figure 2:
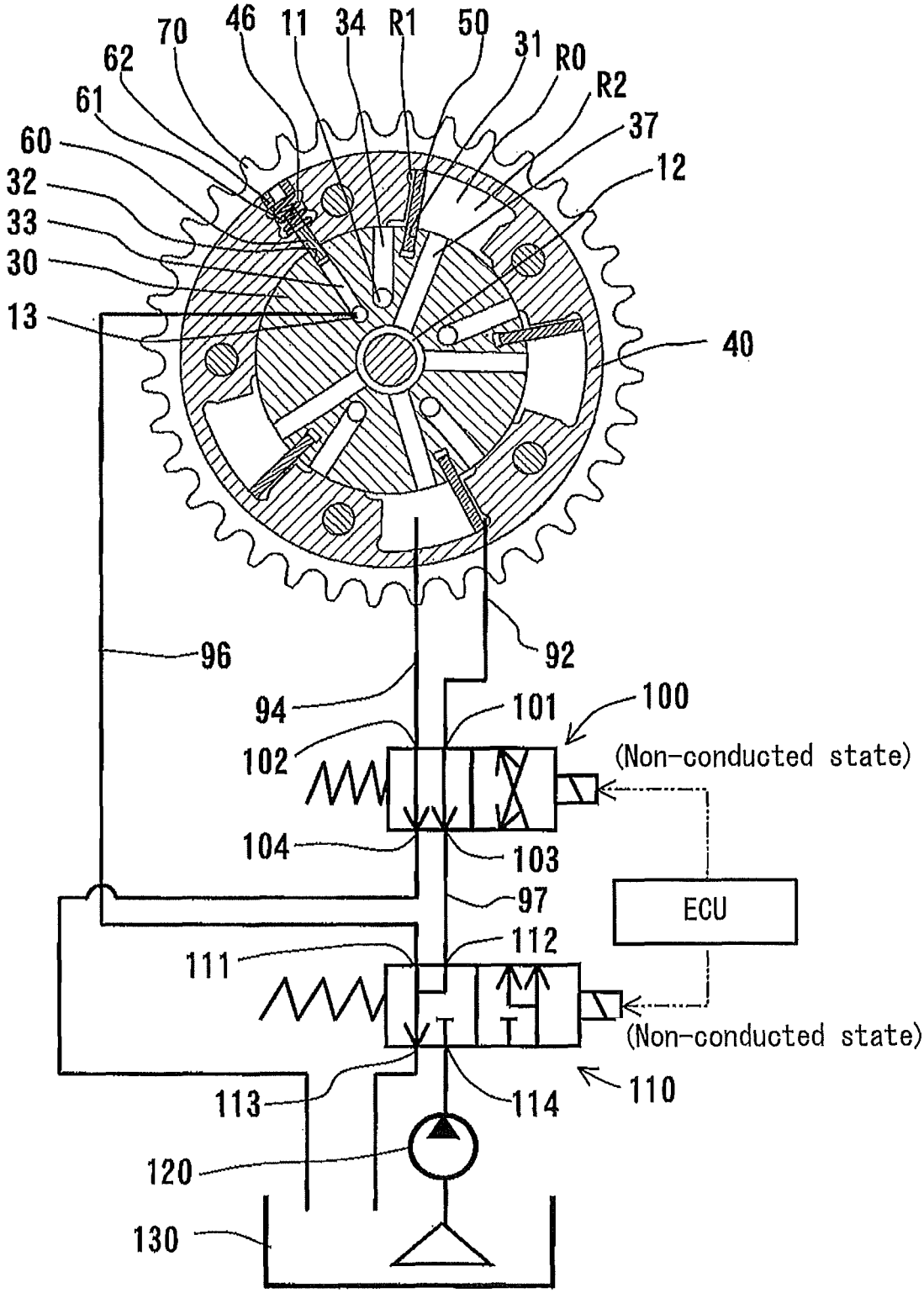
FIG. 2 illustrates an entire configuration diagram indicating a valve opening/closing timing control mechanism of the valve timing control apparatus in the first embodiment where the valve timing control apparatus is in a locked state.

A valve timing control apparatus related to this disclosure indicated in FIGS. 1 and 2 is configured by a rotational shaft portion for opening/closing a valve and a rotation transmitting member. The rotational shaft portion includes a camshaft 10, an inner rotor 30 and vanes 50 attached to the inner rotor 30. The rotation transmitting member includes an outer rotor 40, a lock plate 60 and a timing sprocket 70. The outer rotor 40 is attached to an outer circumferential surface of the rotational shaft portion so as to be relative rotatable with the rotational shaft portion within a predetermined range. The camshaft 10 is supported by a cylinder head 81 at an outer circumferential surface of the camshaft 10 so as to be freely rotatable. A rotational force in a clockwise direction in FIG. 2 is transmitted from the crankshaft to the timing sprocket 70 by means of a timing chain in a known manner.

The camshaft 10 includes known cams for opening/closing an intake valve and an exhaust valve and is formed with an advanced angle passage 11, a retarded angle passage 12 and a pilot passage 13, each of which is formed so as to extend in a axial direction of the camshaft 10. The advanced angle passage 11 is connected to a connecting port 101 of a first switching valve 100 via an annular passage 91 and a connecting passage 92. The annular passage 91 is formed on an inner circumferential surface of the cylinder head 81 at which the camshaft 10 is supported. The retarded angle passage 12 is formed within a bore into which an attachment bolt 16 is inserted, the bore being formed in the camshaft 10. The retarded angle passage 12 is connected to a connecting port 102 of the first switching valve 100 via an annular passage 93 and a connecting passage 94. The annular passage 93 is formed at the inner circumferential surface of the cylinder head 81 at which the camshaft 10 is supported. The pilot passage 13 is connected to a connecting port 111 of a second switching valve 110 via an annular passage 95 and a connecting passage 96. The annular passage 95 is formed at the inner circumferential surface of the cylinder head 81 at which the camshaft 10 is supported. A supplying port 103 of the first switching valve 100 is connected to a connecting port 112 of the second switching valve 110 via a connecting passage 97.

The first switching valve 100 is controlled by an electric control unit ECU so as to be switched to an advanced position or a retarded position. In a state where the first switching valve 100 is switched to be in the advanced position as illustrated in FIG. 1, the supplying port 103 is connected to the connecting port 101 so as to communicate therewith, and the connecting port 102 is connected to a discharging port 104, which is connected to an oil pan 130, so as to communicate therewith. In a state where the first switching valve 100 is moved rightward so as to be in the retarded position so that a non-conducting state in FIGS. 1 and 2 is turned to be a conducting state, the supplying port 103 is connected to the connecting port 102 so as to communicate therewith, and the connecting port 101 is connected to the discharging port 104 so as to communicate therewith.

Thus, in a state where the first switching valve 100 is switched to the advanced position, oil is supplied by an oil pump 120 (e.g., a fluid pump) to the advanced angle passage 11 via the second switching valve 110, at the same time, oil is discharged from the retarded angle passage 12 to the oil pan 130. Further, in a state where the first switching valve 100 is switched to the retarded position, the oil is supplied by the oil pump 120 to the retarded angle passage 12 via the second switching valve 110, at the same time, the oil is discharged from the advanced angle passage 11 to the oil pan 130.

The electric control unit ECU controls the second switching valve 110 so as to be switched to a supplying position and a discharging position. As illustrated in FIG. 1, when the second switching valve 110 is switched to the supplying position, the connecting port 111 and the connecting port 112 are connected to a supplying port 114 that is connected to the oil pump 120 so as to be in communication therewith, and the communications between a discharging port 113 and each of the connecting port 111 and the connecting port 112 are interrupted. When the second switching valve 110 is switched to the discharging position, the communications between the supplying port 114 and each of the connecting port 111 and the connecting port 112 are interrupted, and each of the connecting port 111 and the connecting port 112 is connected to the discharging port 113 so as to communicate therewith. Thus, when the second switching valve 110 is in the supplying position, the oil is supplied to the pilot passage 13 and the supplying port 103 of the first switching valve 100, and when the second switching valve 103 is in the discharging position, the oil is discharged through the pilot passage 13 and the supplying port 103 of the first switching valve 100 to the oil pan 130.

The inner rotor 30 is fixed to the camshaft 10 so as to be integral therewith by means of the bolt 16. The inner rotor 30 is formed with vane grooves 31, a receiving groove 32, a connecting passage 33, connecting passages 34 and connecting passages 37. In this embodiment, four vanes 50 are attached to the vane grooves 31 so as to extend in a radial direction of the inner rotor 30, respectively. The receiving groove 32 is formed so as to receive a head portion of the lock plate 60, so that the head portion of the lock plate 60 is inserted at a predetermined depth, when the inner rotor 30 is in a state indicated in FIGS. 1 and 2, specifically where the rotational shaft portion configured by the camshaft 10, the inner rotor 30 and the like and the rotation transmitting member configured by the outer rotor 40, the timing pulley 70 and the like are synchronized at a predetermined phase. The connecting passage 33 connects a bottom portion of the receiving groove 32 to the pilot passage 13, each of the connecting passages 34 connects an advanced angle chamber R1, formed by means of the vane 50, to the advanced angle passage 11, and each of the connecting passages 37 connects a retarded angle chamber R2, formed by means of the vane 50, to the retarded angle passage 12. Each of the vanes 50 is biased outwardly in a radial direction of the inner rotor 30 by means of a spring housed at the bottom portion of the vane groove 31.

The outer rotor 40 is attached to an outer circumferential surface of the inner rotor 30 so as to be relatively rotatable therewith in a predetermined rotational range. A front plate 41 is attached to one end surface of the outer rotor 40 in an axial direction thereof, and a rear plate 42 is attached to the other end surface of the outer rotor 40 in the axial direction thereof, and the front plate 41, the rear plate 42 and the outer rotor 40 are integrally fixed together by means of bolts 43. The outer rotor 40 is formed with recessed portions, and an operating chamber R0 (e.g., a fluid pressure chamber) is regulated by each of the recessed portions of the outer rotor 40 and an outer circumferential surface of the inner rotor 30. Each of the operating chambers R0 is divided into two chambers, the advanced angle chamber R1 and the retarded angle chamber R2, by means of the vane 50. The outer rotor 40 is also formed with a retracting groove 46 so as to extend in an radial direction of the outer rotor 40, and the retracting groove 46 houses the lock plate 60 and a spring 61 for biasing the lock plate 60 toward the inner rotor 30.

The lock plate 60 is inserted into the retracting groove 46 so as to be movable in the radial direction of the outer rotor 40, and the spring 61 biases the lock plate 60 toward the inner rotor 30. The spring 61 is provided between the lock plate 60 and a retainer 62 in a compressed manner, and the retainer 62 is fixedly mounted to the outer rotor 40.

In the embodiments, a lock mechanism is configured by the receiving groove 32, the retracting groove 46, the lock plate 60 (e.g., a regulating member), the spring 61 and the retainer 62. The lock mechanism is used for restrict the rotational phase of the inner rotor relative to the outer rotor at a predetermined phase between a most advanced angle phase and a most retarded angle phase.

Figure 3:
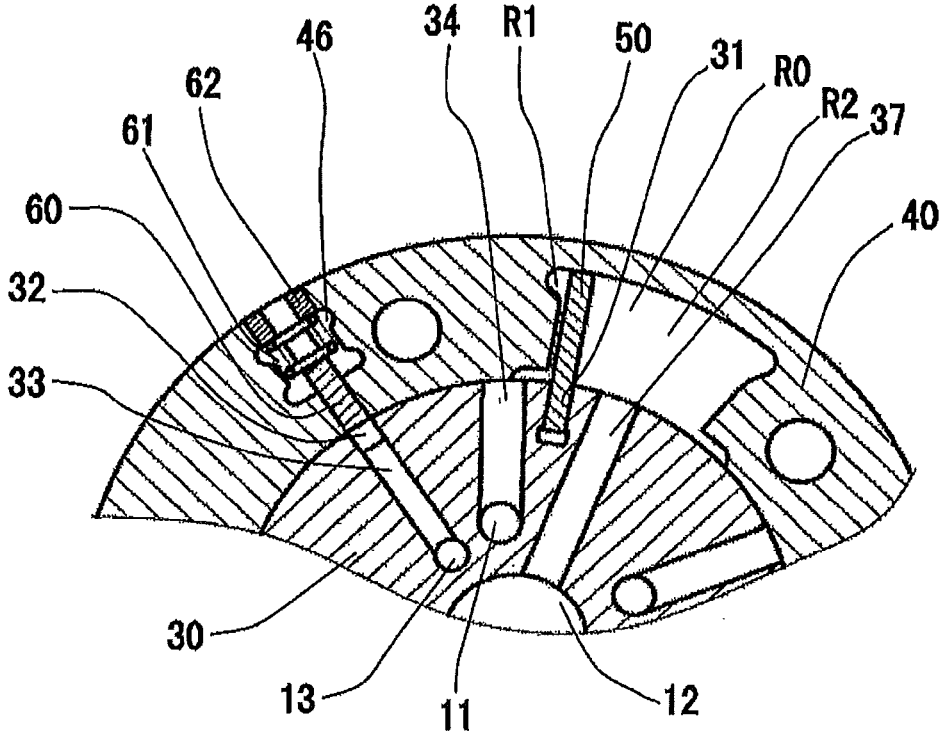
FIG. 3 illustrates a partial cross section of the valve opening/closing timing control mechanism where the valve timing control apparatus is in an unlocked state and in a most retarded angle state.

According to the valve timing control apparatus of this disclosure, when a most retarded angle where an volume of the advanced angle chamber R1 reaches a minimum is established, at the same time the lock plate 60 is in a locked state as illustrated in FIG. 2, by conducting the second switching valve 110 on the basis of a signal of the electric control unit ECU, as illustrated in FIG. 1, the oil is supplied to the pilot passage 13 and the first switching valve 100 from the oil pump 120 by means of the second switching valve 110. When the oil supplied to pilot passage 13 further flows in the receiving groove 32, as illustrated in FIG. 3, the lock plate 60 is pressed by the pressure of the oil in a direction against the biasing force of the spring 61, and the lock plate 60 is disengaged from the receiving groove 32 and moves so as to be retracted into the retracting groove 46. Thus, the lock plate 60 turns in an unlocked state, and the rotational shaft portion configured by the camshaft 10, the inner rotor 30, the vanes 50 and the like may rotate in the clockwise direction in FIG. 3 relative to the rotation transmitting member configured by the outer rotor 40 and the like.

In a state where the most retarded angle where the volume of the advanced angle chamber R1 reaches the minimum is established, and the lock plate 60 is in an unlocked state as illustrated in FIG. 3, the oil is supplied to the advanced angle chamber R1 from the oil pump 120 via the first switching valve 100 switched to the advanced position and the advanced angle passage 11. At the same time, the oil is discharged from the retarded angle chamber R2 to the oil pan 130. At this point, the rotational shaft portion configured by the camshaft 10, the inner rotor 30, the vanes 50 and the like rotates in the clockwise direction in FIG. 3 relative to the rotation transmitting member configured by the outer rotor 40 and the like, and eventually a most advanced angle state where a volume of the retarded angle chamber R2 reaches a minimum is established as illustrated in FIG. 4.

Figure 4:
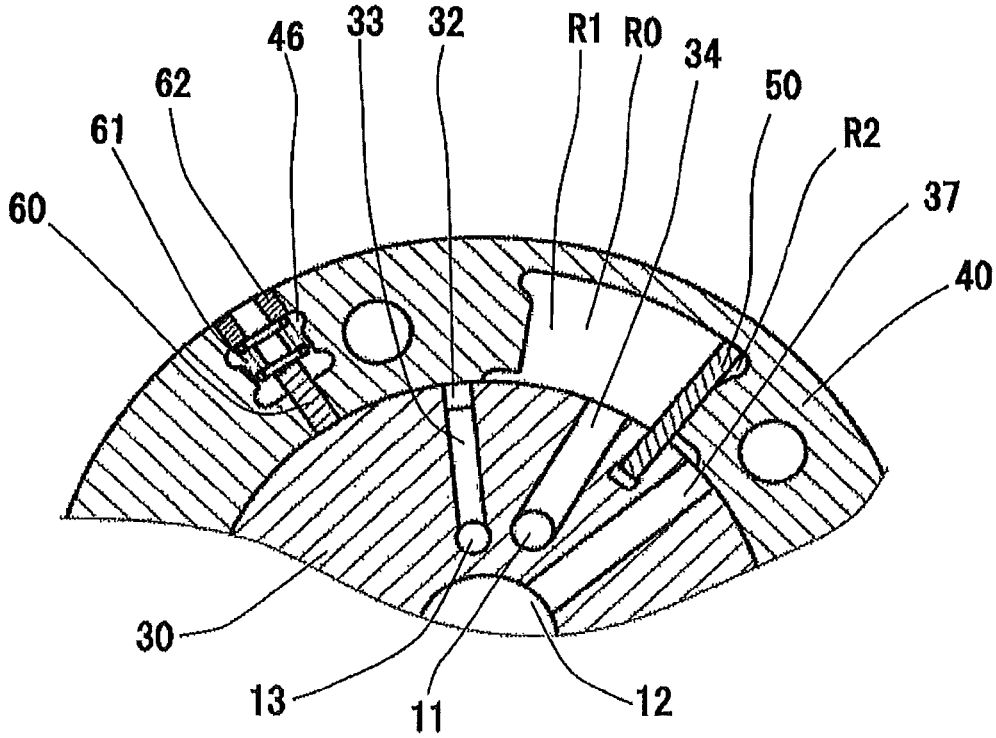
FIG. 4 illustrates a partial cross section of the valve opening/closing timing control mechanism where the valve timing control apparatus is in a most advanced angle state.

In a state where: the most advanced angle where a volume of the retarded angle chamber R2 reaches the minimum is established; the lock plate 60 is in an unlocked state as illustrated in FIG. 4; the oil is supplied to the retarded angle chamber R2 from the oil pump 120 via the first switching valve 100 switched to the retarded position and the retarded angle passage 12; and the oil is discharged from the advanced angle chamber R1 to the oil pan 130, the rotational shaft portion configured by the camshaft 10, the inner rotor 30, the vanes 50 and the like rotates in the counterclockwise direction in FIG. 4 relative to the rotation transmitting member configured by the outer rotor 40 and the like, and eventually a most retarded angle state where a volume of the advanced angle chamber R1 reaches the minimum is established as illustrated in FIG. 3.

While the internal combustion engine is driven, the valve opening/closing timing is controlled in a manner where the valve timing control apparatus is switched to a most retarded angle or a most advanced angle chamber in response to the driving condition of the internal combustion engine.

When the valve timing control apparatus being in the most advanced angle state as illustrated in FIG. 4 is turned to be in the most retarded angle state as illustrated in FIG. 3, because the receiving groove 32, the receiving groove 32 not directly communicating with the retracting groove 46 is turned to be a state where the receiving groove 32 is directly communicated with the retracting groove 46, the pressure of the oil supplied to the receiving groove 32 via the pilot passage 13 may be applied to the lock plate 60 so as to move against the biasing force of the spring 61, and the lock plate 60 is retracted within the retracting groove 46 of the outer rotor 40, where the lock plate 60 does not contact the outer circumferential surface of the inner rotor 30.

According to the valve timing control apparatus in the first embodiment, the oil flow from/to the oil pump 120 to/from the advanced angle passage or the retarded angle passage 12 is switched by the first switching valve 100 via the second switching valve 110.

Further, the oil flow from/to the oil pump 120 to/from the pilot passage 13 is switched by the second switching valve 110. Furthermore, because the oil supply to the pilot passage 13 and the oil discharge from the pilot passage 13 is controlled independently from the control of the oil supplied to/discharged from the advanced angle passage 11 or the retarded angle passage 12, when the internal combustion engine is started, the second switching valve 110 is turned to be in the non-conducted state, thereby not supplying the oil to the first switching valve 100 and the pilot passage 13.

Accordingly, even when the lock plate 60 is not inserted into the receiving groove 32 before the internal combustion engine is started, because the oil is not supplied to both of the advanced angle chamber R1 and the retarded angle chamber R2, the lock plate 60 may be inserted into the receiving groove 32 by use of the small oscillating movements of the inner rotor 30 caused by a torque fluctuation of the camshaft 10, thereby surely establishing the locked state between the inner rotor 30 and the outer rotor 40 when the internal combustion engine is started.

After the internal combustion engine is started, the second switching valve 110 is turned to be in the conducted state (the state in FIG. 1), the oil is supplied from the oil pump 120 to the pilot passage 13 and the first switching valve 100, and the head portion of the lock plate 60 is retracted from the receiving groove into the retracting groove 46, thereby maintaining the unlocked state between the inner rotor 30 and the outer rotor 40. In this configuration, the amount of the oil supplied to the advanced angle chamber R1 or the retarded angle chamber R2 is controlled by the first switching valve 100 in order to achieve an appropriate valve opening/closing timing.

<Second Embodiment>

Figure 5:
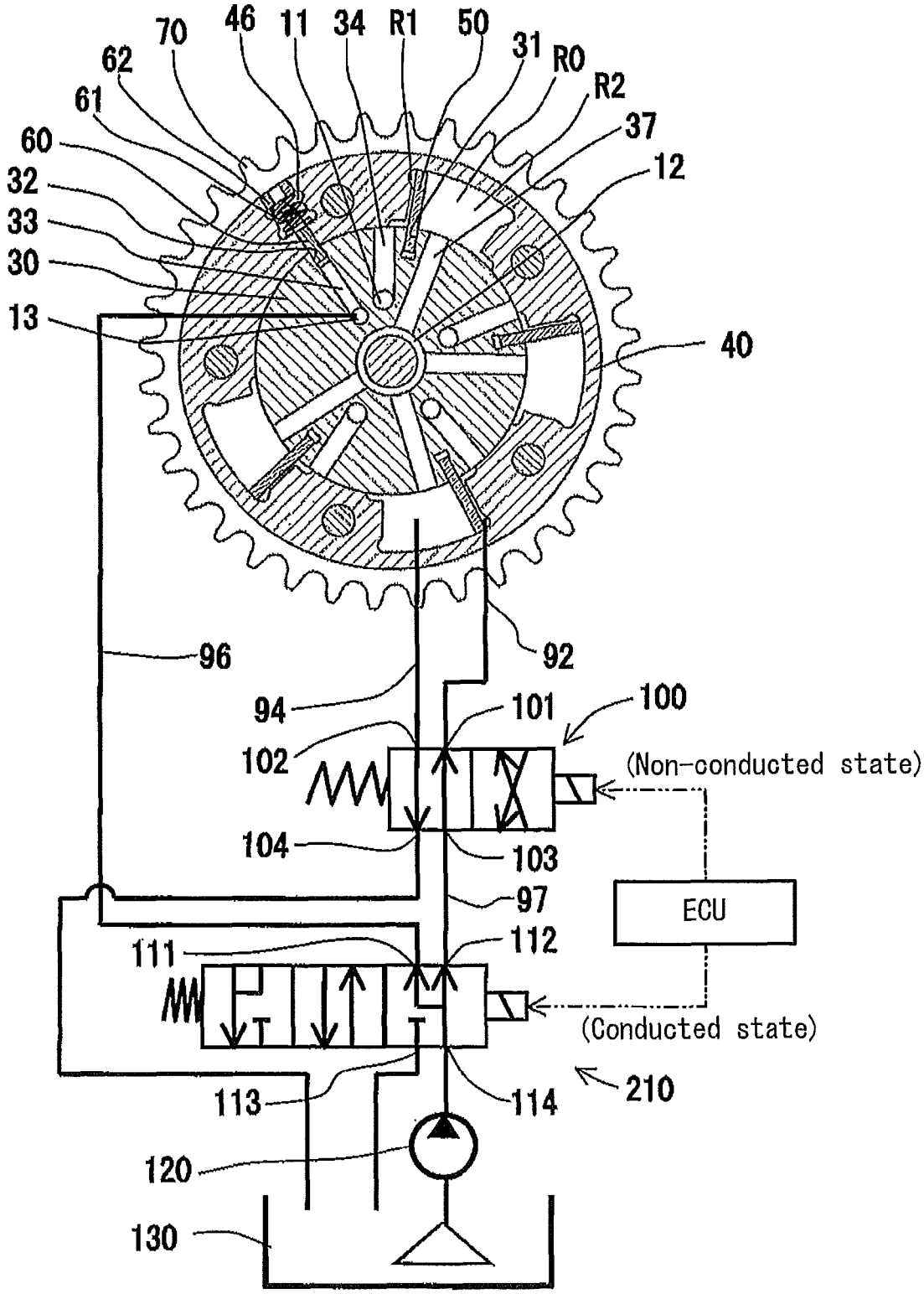
FIG. 5 illustrates an entire configuration diagram indicating a second embodiment of a valve timing control apparatus of this disclosure.

FIG. 5 indicates a second embodiment of this disclosure. In the second embodiment, a second switching valve 210 having four ports arranged at three positions is used. The second switching valve 210 is basically similar to the second switching valve 110 in the first embodiment including four ports arranged at two positions.

The second switching valve 210 is switched to a supplying position, a discharging position and a third position. Specifically, when the second switching valve 210 is switched to the supplying position, the oil is supplied to the pilot passage 13 and the supplying port 103 of the first switching valve 100. When the second switching valve 210 is switched to the discharging position, the oil is discharged from the pilot passage 13 and the supplying port 103 of the first switching valve 100 to the oil pan 130. When the second switching valve is switched to the third position, the oil is supplied to the first switching valve 100 and is discharged from the pilot passage 13.

When the internal combustion engine is started, even when the lock plate 60 is not inserted in the receiving groove 32, the second switching valve 210 is switched to the discharging position, and the oil is not supplied to the advanced angle chamber R1 and the retarded angle chamber R2 and is discharged therefrom to the oil to the oil pan 130.

Accordingly, the lock plate 60 is inserted into the receiving groove 32 by use of the small oscillating movements of the inner rotor 30 caused by a torque fluctuation of the camshaft 10, thereby surely establishing the locked state between the inner rotor 30 and the outer rotor 40 when the internal combustion engine is started.

Immediately after the internal combustion engine is started, when the lock plate 60 is retracted from the receiving groove 32 under a circumstance where the amount of the oil in the advanced angle chamber R1 and the retarded angle chamber R2 are relatively low, the valve opening/closing timing may not be appropriately controlled due to small oscillating movements caused by the torque fluctuation of the camshaft 10.

In this case, the second switching valve 210 is switched to the third position, thereby supplying the oil to the advanced angle chamber R1 or the retarded angle chamber R2 in order to reduce the small oscillating movements. When the second switching valve 210 is switched to the supplying position after the advanced angle chamber R1 and the retarded angle chamber R2 are filled with the oil, the oil is supplied to the pilot passage 13 so that the lock plate 60 is retracted from the receiving groove 32, thereby establishing an unlocked state. At the same time, the oil is supplied to the supplying port 103 of the first switching valve 100 so that the control of the valve opening/closing timing may be activated.

<Third Embodiment>

Figure 6:
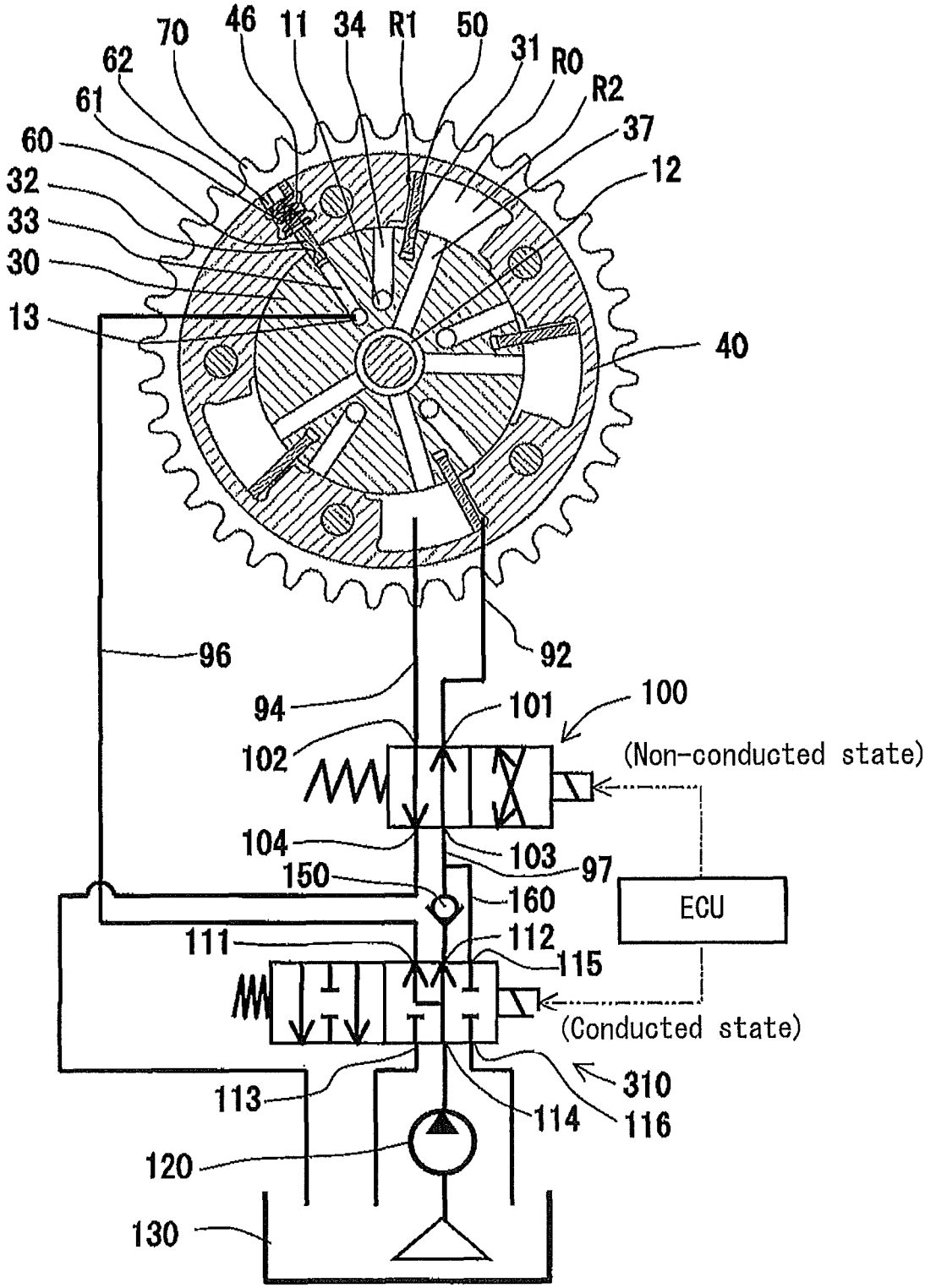
FIG. 6 illustrates an entire configuration diagram indicating a third embodiment of a valve timing control apparatus of this disclosure.

FIG. 6 indicates a third embodiment of this disclosure. In the third embodiment, a second switching valve 310 having six ports arranged at two positions is used. The second switching valve 310 is basically similar to the second switching valve 110 of the first embodiment including four ports arranged at two positions. Further, a check valve 150 is provided at the connecting passage 97 by which the supplying port 103 of the first switching valve 100 is connected to the connecting port 112 of the second switching valve 310. Furthermore, a bypass passage 160 is provided so as to be branched from the connecting passage 97 at a position between the check valve 150 and the first switching valve 100 and is connected to the second switching valve 310.

The second switching valve 310 in the third embodiment is switched to a supplying position and a discharging position. When the second switching valve 310 is switched to the supplying position, the oil is supplied to the pilot passage 13 and the supplying port 103 of the first switching valve 100, and the bypass passage 160 is interrupted. When the second switching valve 310 is switched to the discharging position, the oil is discharged from the pilot passage 13 and the bypass passage 160 to the oil pan 130, and the connecting passage 97 connecting the first switching valve 100 to the supplying port 103 interrupted.

When the internal combustion engine is started, even when the lock plate 60 is not inserted in the receiving groove 32, because the second switching valve 310 is switched to the discharging position, the oil is not supplied to the advanced angle chamber R1 and the retarded angle chamber R2, thereby discharging the oil therefrom to the oil pan 130.

Accordingly, the lock plate 60 is inserted into the receiving groove 32 by use of the small oscillating movements of the inner rotor 30 caused by a torque fluctuation of the camshaft 10, thereby surely establishing the locked state between the inner rotor 30 and the outer rotor 40 when the internal combustion engine is started.

After the internal combustion engine is started, the second switching valve 310 is switched to the conducting state as illustrated in FIG. 6 for supplying the oil from the oil pump 120 to the pilot passage 13 and the first switching valve 100. In this state, the lock plate 60 inserted in the receiving groove 32 is moved in such a way that the head portion of the lock plate 60 is retracted to the retracting groove 46, thereby maintaining the unlocked state between the inner rotor 30 and the outer rotor 40. At the same time, the first switching valve 100 controls the amount of the oil supplied to the advanced angle chamber R1 and the retarded angle chamber R2 in order to control the valve opening/closing timing.

Further, because the check valve 150 is provided at the connecting passage 97, the oil pressure in the pilot passage 13, by which the unlocked state between the inner rotor 30 and the outer rotor 40 is maintained, may be prevented from being affected by oil pulsation caused by the torque fluctuation of the camshaft 10 occurring after the unlocked state between the inner rotor 30 and the outer rotor 40 is established, thereby maintaining a stable unlocked state.

<Fourth Embodiment>

Figure 7:
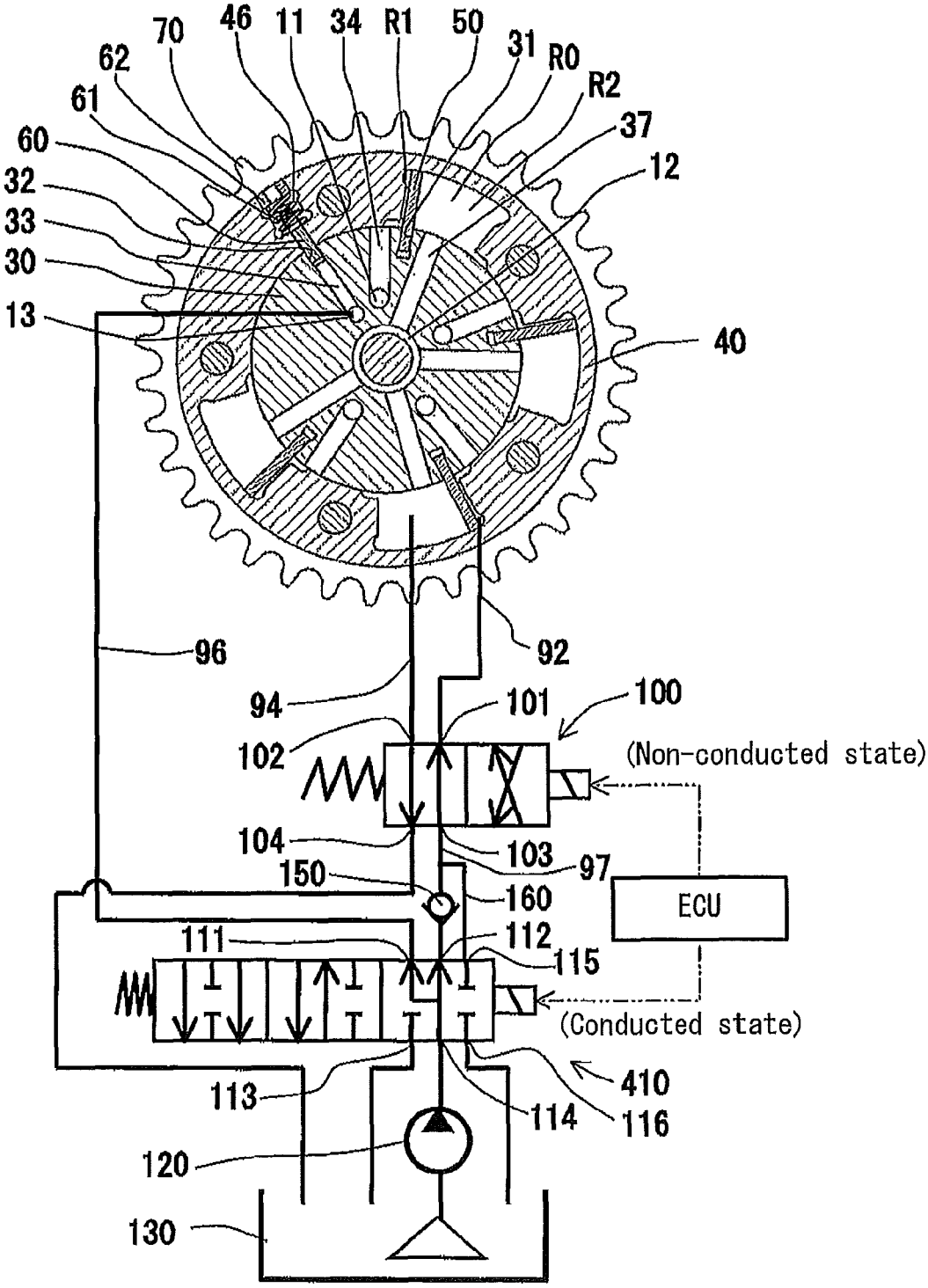
FIG. 7 illustrates an entire configuration diagram indicating a fourth embodiment of a valve timing control apparatus of this disclosure.

FIG. 7 indicates a fourth embodiment of this disclosure. In the fourth embodiment, a second switching valve 410 having six ports arranged at three positions is used. The second switching valve 410 is basically similar to the second switching valve 310 in the third embodiment including six ports at two positions.

The second switching valve 410 in the fourth embodiment is switched to a supplying position, a discharging position and a third position. When the second switching valve 410 is switched to the supplying position, the oil is supplied to the pilot passage 13 and the supplying port 103 of the first switching valve 100, and the bypass passage 160 is interrupted. When the second switching valve 410 is switched to the discharging position, the oil is discharged from the pilot passage 13 and the bypass passage 160 to the oil pan 130, and the connecting passage 97 connecting the second switching valve 410 to the supplying port 103 is interrupted. When the second switching valve 410 is switched to the third position, the oil is supplied to the first switching valve 100 and is discharged from the pilot passage 13, and the bypass passage 160 is interrupted.

When the internal combustion engine is started, even when the lock plate 60 is not inserted in the receiving groove 32, because the second switching valve is switched to the discharging position, the oil is not supplied to the advanced angle chamber R1 and the retarded angle chamber R2, thereby discharging the oil therefrom to the oil pan 130.

Accordingly, the lock plate 60 is inserted into the receiving groove 32 by use of the small oscillating movements of the inner rotor 30 caused by a torque fluctuation of the camshaft 10, thereby surely establishing the locked state between the inner rotor 30 and the outer rotor 40 when the internal combustion engine is started.

Immediately after the internal combustion engine is started, when the lock plate 60 is retracted from the receiving groove 32 under a circumstance where the amount of the oil in the advanced angle chamber R1 and the retarded angle chamber R2 are relatively low, the valve opening/closing timing may not be appropriately controlled due to small oscillating movements caused by the torque fluctuation of the camshaft 10.

In this case, the second switching valve 410 is switched to the third position, thereby supplying the oil to the advanced angle chamber R1 or the retarded angle chamber R2 in order to reduce the small oscillating movements. When the second switching valve 410 is switched to the supplying position after the advanced angle chamber R1 and the retarded angle chamber R2 are filled with the oil, the oil is supplied to the pilot passage 13 so that the lock plate 60 is retracted from the receiving groove 32, thereby establishing an unlocked state. At the same time, the oil is supplied to the supplying port 103 of the first switching valve 100 so that the control of the valve opening/closing timing may be activated.

Further, because the check valve 150 is provided at the connecting passage 97, the oil pressure in the pilot passage 13, by which the unlocked state between the inner rotor 30 and the outer rotor 40 is maintained, may be prevented from being affected by oil pulsation caused by the torque fluctuation of the camshaft 10 occurring after the unlocked state between the inner rotor 30 and the outer rotor 40 is established, thereby maintaining a stable unlocked state.

<Fifth Embodiment>

Figure 8:
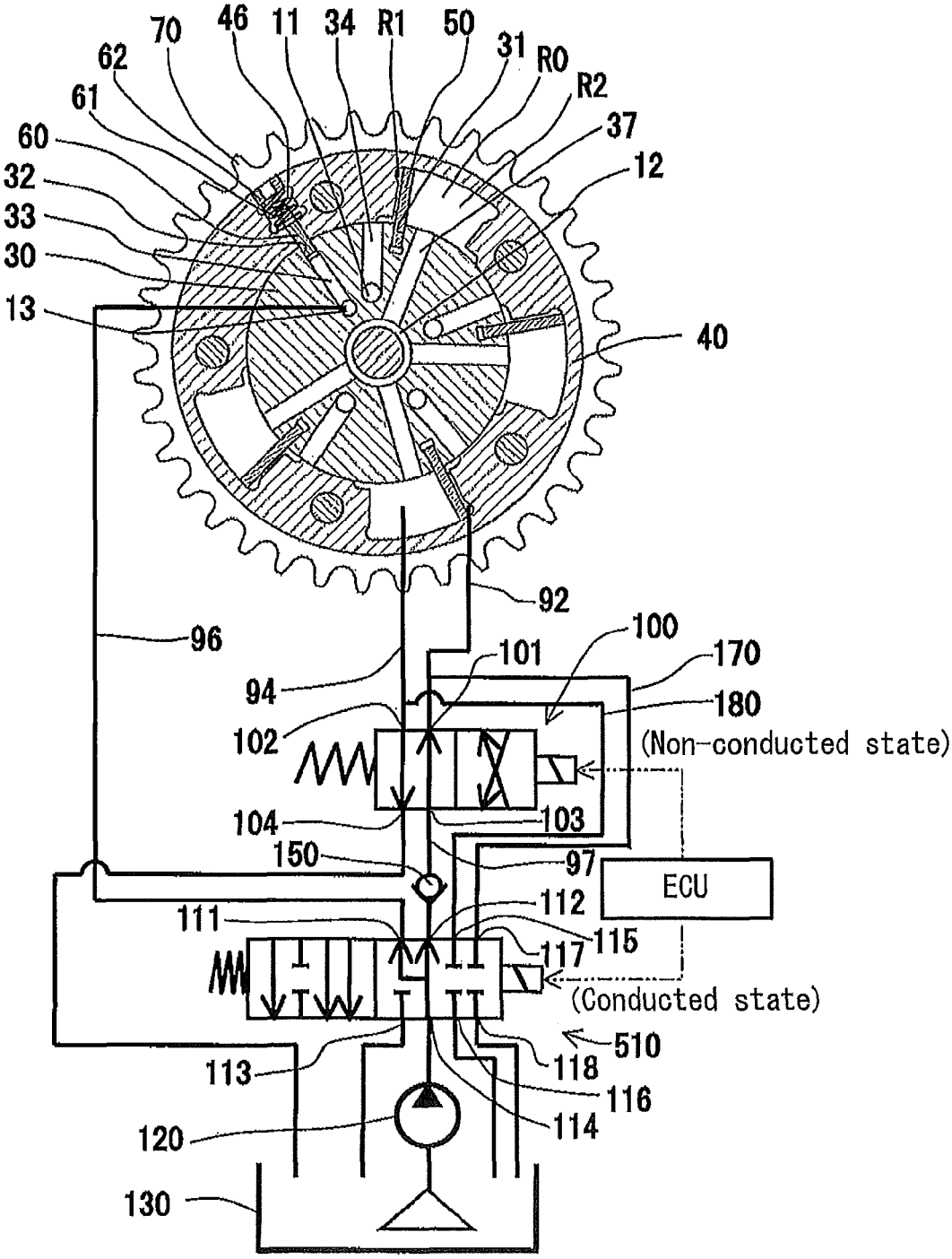
FIG. 8 illustrates an entire configuration diagram indicating a fifth embodiment of a valve timing control apparatus of this disclosure.

FIG. 8 indicates a fifth embodiment of this disclosure. In the fifth embodiment, a second switching valve 510 having eight ports at two positions is used. The second switching valve 510 is basically similar to the second switching valve 310 in the third embodiment including six ports at two positions.

Further, instead of the bypass passage 160 in the third embodiment, a first bypass passage 170 and a second bypass passage 180 are provided in the fifth embodiment. The first bypass passage 170 is branched from the connecting passage 92, connecting the advanced angle passage 11 to the first switching valve 100, and is connected to the second switching valve 510. The second bypass passage 180 is branched from the connecting passage 94, connecting the retarded angle passage 12 to the first switching valve 100, and is connected to the second switching valve 510.

The second switching valve 510 in the fifth embodiment is switched to a supplying position and a discharging position. When the second switching valve 510 is switched to the supplying position, the oil is supplied to the pilot passage 13 and the supplying port 103 of the first switching valve 100, and the first bypass passage 170 and the second bypass passage 180 are interrupted. When the second switching valve 510 is switched to the discharging position, the oil is discharged from the pilot passage 13, the first bypass passage 170 and the second bypass passage 180 to the oil pan 130, and the connecting passage 97 connecting the supplying port 103 of the first switching valve 100 to the second switching valve 510 is interrupted.

When the internal combustion engine is started, even when the lock plate 60 is not inserted in the receiving groove 32, because the second switching valve 510 is switched to the discharging position, the oil is not supplied to the advanced angle chamber R1 and the retarded angle chamber R2, thereby discharging the oil therefrom to the oil pan 130.

Accordingly, the lock plate 60 is inserted into the receiving groove 32 by use of the small oscillating movements of the inner rotor 30 caused by a torque fluctuation of the camshaft 10, thereby surely establishing the locked state between the inner rotor 30 and the outer rotor 40 when the internal combustion engine is started.

Thus, when the oil in the advanced angle chamber R1 or the retarded angle chamber R2 is discharged by use of the small oscillating movements of the inner rotor 30, the oil may be discharged through the first bypass passage 170 or the second bypass passage 180, without passing through the first switching valve 100. Accordingly, a level of discharging resistance of the oil to be discharged may be reduced, and the lock plate 60 may be inserted into the receiving groove 32 by the small oscillating movements whose frequency is relatively low compared to the third embodiment.

After the internal combustion engine is started, the second switching valve 510 is switched to the conducting state as illustrated in FIG. 8 for supplying the oil from the oil pump 120 to the pilot passage 13 and the first switching valve 100. In this state, the lock plate 60 inserted in the receiving groove 32 is moved in such a way that the head portion of the lock plate 60 is retracted to the retracting groove 46, thereby maintaining the unlocked state between the inner rotor 30 and the outer rotor 40. At the same time, the first switching valve 100 controls the amount of the oil supplied to the advanced angle chamber R1 and the retarded angle chamber R2 in order to control the valve opening/closing timing.

Further, because the check valve 150 is provided at the connecting passage 97, the oil pressure in the pilot passage 13, by which the unlocked state between the inner rotor 30 and the outer rotor 40 is maintained, may be prevented from being affected by oil pulsation caused by the torque fluctuation of the camshaft 10 occurring after the unlocked state between the inner rotor 30 and the outer rotor 40 is established, thereby maintaining a stable unlocked state.

<Sixth Embodiment>

Figure 9:
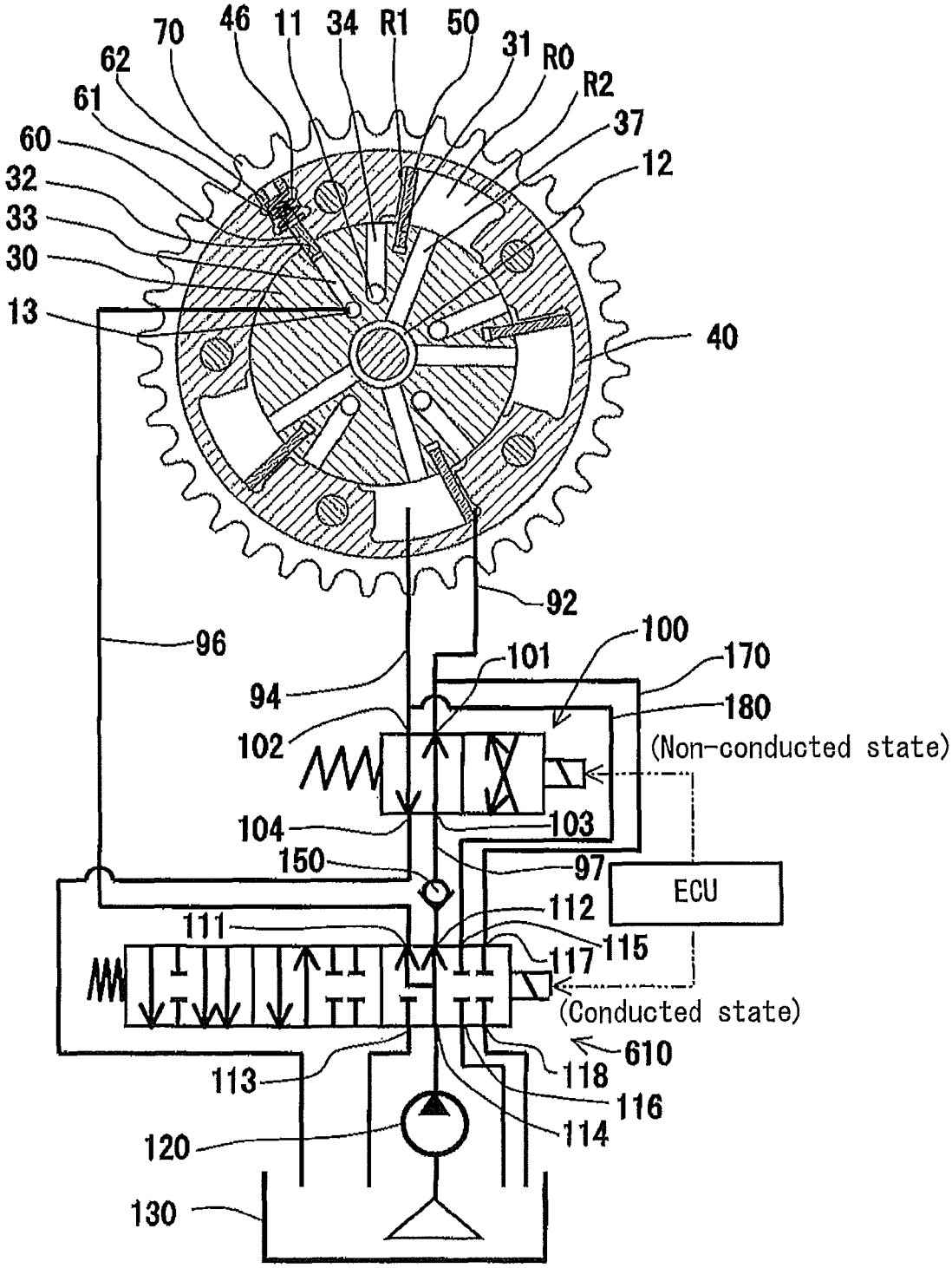
FIG. 9 illustrates an entire configuration diagram indicating a sixth embodiment of a valve timing control apparatus of this disclosure.

FIG. 9 indicates a sixth embodiment of this disclosure. In the sixth embodiment, a second switching valve 610 having eight ports arranged at three positions is used. The second switching valve 610 is basically similar to the second switching valve 510 in the fifth embodiment including eight ports arranged at two positions.

The second switching valve 610 is switched to a supplying position, a discharging position and a third position. Specifically, when the second switching valve 610 is switched to the supplying position, the oil is supplied to the pilot passage 13 and the supplying port 103 of the first switching valve 100. When the second switching valve 610 is switched to the discharging position, the oil is discharged from the pilot passage 13, the first bypass passage 170 and the second bypass passage 180 to the oil pan 130, and the connecting passage connected to the first switching valve 100 is interrupted. When the second switching valve is switched to the third position, the oil is supplied to the first switching valve 100 and is discharged from the pilot passage 13, and the first bypass passage 170 and the second bypass passage 180 are interrupted.

When the internal combustion engine is started, even when the lock plate 60 is not inserted in the receiving groove 32, because the second switching valve 610 is switched to the discharging position, the oil is not supplied to the advanced angle chamber R1 and the retarded angle chamber R2, thereby discharging the oil therefrom to the oil pan 130.

Accordingly, the lock plate 60 is inserted into the receiving groove 32 by use of the small oscillating movements of the inner rotor 30 caused by a torque fluctuation of the camshaft 10, thereby surely establishing the locked state between the inner rotor 30 and the outer rotor 40 when the internal combustion engine is started.

Thus, when the oil in the advanced angle chamber R1 or the retarded angle chamber R2 is discharged by use of the small oscillating movements of the inner rotor 30, the oil may be discharged through the first bypass passage 170 or the second bypass passage 180, without passing through the first switching valve 100. Accordingly, a level of discharging resistance of the oil to be discharged may be reduced, and the lock plate 60 may be inserted into the receiving groove 32 by the small oscillating movements whose frequency is relatively low compared to the third embodiment.

Immediately after the internal combustion engine is started, when the lock plate 60 is retracted from the receiving groove 32 under a circumstance where the amount of the oil in the advanced angle chamber R1 and the retarded angle chamber R2 are relatively low, the valve opening/closing timing may not be appropriately controlled due to small oscillating movements caused by the torque fluctuation of the camshaft 10.

In this case, the second switching valve 610 is switched to the third position, thereby supplying the oil to the advanced angle chamber R1 or the retarded angle chamber R2 in order to reduce the small oscillating movements. When the second switching valve 610 is switched to the supplying position after the advanced angle chamber R1 and the retarded angle chamber R2 are filled with the oil, the oil is supplied to the pilot passage 13 so that the lock plate 60 is retracted from the receiving groove 32, thereby establishing an unlocked state. At the same time, the oil is supplied to the supplying port 103 of the first switching valve 100 so that the control of the valve opening/closing timing may be activated.

Further, because the check valve 150 is provided at the connecting passage 97, the oil pressure in the pilot passage 13, by which the unlocked state between the inner rotor 30 and the outer rotor 40 is maintained, may be prevented from being affected by oil pulsation caused by the torque fluctuation of the camshaft 10 occurring after the unlocked state between the inner rotor 30 and the outer rotor 40 is established, thereby maintaining a stable unlocked state.

In the abovementioned embodiments, the second switching valve is switched by means of an electric control, however, the second switching valve may be switched by means of a hydraulic control.

In those configurations, the second switching valve for controlling the fluid supplied to/discharged from the third fluid passage may be operated independently from the operation of the first switching valve for controlling the fluid supplied to/discharged from the first fluid passage and the second fluid passage. Accordingly, the at the time of the start of the internal combustion engine, the fluid is not supplied to the first switching valve in such a way that the second switching valve is turned in a non-conducting state (in a case where the second switching valve is switched by means of an electric control), or the fluid does not actuate on the second switching valve (in a case where the second switching valve is switched by means of a hydraulic control). Thus, because the fluid is not supplied to the advanced angle chamber and the retarded angle chamber, the regulating member may be inserted into the receiving groove by use of the small oscillating movements caused by the torque fluctuation of the camshaft, accordingly, at the time of the start of the internal combustion engine, the valve timing control apparatus may be surely regulated in the locked state.

Further, because the second switching valve is switched to the first position at which the fluid is supplied to the first switching valve and the third fluid passage and is switched to the second position at which the fluid is discharged from the first switching valve and the third fluid passage, the fluid passage may be easily selected by controlling the electric supply to the second switching valve or by controlling the hydraulic pressure to the second switching valve.

Furthermore, because the second switching valve includes the third position at which the fluid is supplied to the first switching valve and discharged from the third fluid passage, before the lock mechanism being in the locked stated is turned to be the unlocked state, the fluid may be supplied to the advanced angle chamber or the retarded angle chamber, as a result, the valve timing control apparatus may be controlled with reducing the small oscillating movements caused by the torque fluctuation of the camshaft occurred immediately, after the lock mechanism is unlocked.

Further, the check valve is provided at the connecting passage connecting the first switching valve to the second switching valve in order to allow the fluid flow to the first switching valve while interrupting the fluid flow to the second switching valve, the bypass passage is formed so as to be branched from the connecting passage and connected to the second switching valve. In this configuration, the second switching valve is switched to the first position at which the fluid is supplied to the first switching valve and the third fluid passage and the bypass passage is interrupted and is switched to the second position at which the connecting passage to the first switching valve is interrupted and the fluid is discharged from the third fluid passage and the bypass passage. Accordingly, after the lock mechanism is unlocked, the fluid pressure of the third fluid passage by which the lock mechanism is maintained to be the unlocked state may not be affected by the pulsation of the fluid caused by the torque fluctuation of the camshaft, as a result, the unlocked state may be stably maintained.

In addition, because the second switching valve is switched to the third position at which the fluid is supplied to the first switching valve via the check valve, the fluid is discharged from the third fluid passage, and the bypass passage is interrupted, before the lock mechanism is unlocked, the fluid is supplied to the advanced angle chamber or the retarded angle chamber, and the valve timing control apparatus may be controlled in such a way that the small oscillating movements caused by the torque fluctuation of the camshaft occurred immediately after the lock mechanism is unlocked are reduced.

Further, the check valve is provided at the connecting passage connecting the first switching valve to the second switching valve in order to allow the fluid flow to the first switching valve while interrupting the fluid flow to the second switching valve, the first bypass passage is formed so as to be branched from the first fluid passage and connected to the second switching valve, the second bypass passage is formed so as to be branched from the second fluid passage and connected to the second switching valve. In this configuration, the second switching valve is switched to the first position at which the fluid is supplied to the first switching valve and the third fluid passage and the first and second bypass passages are interrupted and is switched to the second position at which the connecting passage to the first switching valve is interrupted and the fluid is discharged from the third fluid passage and the first and second bypass passages. When the internal combustion engine is started, without passing through the first switching valve, the oil is discharged from the advanced angle chamber and the retarded angle chamber to the oil pan. Accordingly, the lock plate is rapidly inserted into the receiving groove by use of the small oscillating movements of the inner rotor caused by a torque fluctuation of the camshaft, thereby surely establishing the locked state between the inner rotor and the outer rotor when the internal combustion engine is started.

Furthermore, the second switching valve is switched to the third position. In the third position, the oil is supplied to the first switching valve via the check valve and is discharged from the third fluid passage, and the first bypass passage and the second bypass passage are interrupted. Accordingly, before the lock mechanism being in the locked stated is turned to be in the unlocked state, the oil may be supplied to the advanced angle chamber or the retarded angle chamber, thereby achieving the control of the valve timing control apparatus with reducing the small oscillating movement caused by the torque fluctuation of the camshaft occurred immediately after the unlock.

The regulating member of the lock mechanism may be biased toward the outer circumferential surface of the inner rotor. Specifically, the regulating member may be biased toward a rotational center of the inner rotor rotating integrally with the rotational shaft portion. In other words, the locked state between the inner rotor and the outer rotor established by the regulating member may be released (unlocked) by use of the fluid pressure in the third fluid passage acting in a direction opposite to the direction of the biasing force of the regulating member, together with an usage of a centrifugal force caused by the rotations of the inner rotor and the outer rotor. In this configuration, even when the level of the fluid pressure within the third fluid passage is relatively low, the regulating member may be unlocked by use of the centrifugal force acting on the regulating member.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising: an inner rotor rotating integrally with a camshaft for opening and closing a valve of an internal combustion engine; a vane attached to the inner rotor; an outer rotor mounted to the inner rotor so as to be relative rotatable therewith within a predetermined range and being rotated by a rotational force transmitted from a crankshaft of the internal combustion engine; a fluid pressure chamber formed at an inner portion of the outer rotor and divided into an advanced angle chamber and a retarded angle chamber by the vane; a first fluid passage formed in fluid communication with the advanced angle chamber; a second fluid passage formed in fluid communication with the retarded angle chamber; a lock mechanism used for restricting a relative rotation between the inner rotor and the outer rotor; a third fluid passage formed in fluid communication with the lock mechanism to restrict the relative rotation between the inner rotor and the outer rotor by discharging the fluid from the lock mechanism and to allow the relative rotation between the inner rotor and the outer rotor by supplying the fluid to the lock mechanism; a first switching valve for controlling a fluid flow so as to be supplied to each of the first fluid passage and the second fluid passage and so as to be discharged from each of the first fluid passage and the second fluid passage; and a second switching valve for controlling a fluid flow so as to be supplied to and discharged from the third fluid passage, wherein the first switching valve is operated independently from an operation of the second switching valve, and fluid is supplied to the first switching valve via the second switching valve, and wherein the second switching valve is switchable to a first position at which the fluid is supplied to the first switching valve and the third fluid passage and is switchable to a second position at which the fluid is discharged from the first switching valve and the third fluid passage.

2. The valve timing control apparatus according to claim 1, wherein the second switching valve is switchable to a third position at which the fluid is supplied to the first switching valve and is discharged from the third fluid passage.

3. The valve timing control apparatus according to claim 1, wherein a check valve is provided at a connecting passage for connecting the first switching valve to the second switching valve in order to allow the fluid flow to the first switching valve while interrupting the fluid flow to the second switching valve, a bypass passage is formed so as to be branched from the connecting passage and connected to the second switching valve, and the second switching valve is switchable to a first position at which the fluid is supplied to the first switching valve and the third fluid passage and the bypass passage is interrupted and is switchable to a second position at which the connecting passage is interrupted and the fluid is discharged from the third fluid passage and the bypass passage.

4. The valve timing control apparatus according to claim 3, wherein the second switching valve is switchable to a third position at which the fluid is supplied to the first switching valve via the check valve, the fluid is discharged from the third fluid passage, and the bypass passage is interrupted.

5. The valve timing control apparatus according to claim 1, wherein a check valve is provided at a connecting passage for connecting the first switching valve to the second switching valve in order to allow the fluid flow to the first switching valve while interrupting the fluid flow to the second switching valve, a first bypass passage is formed so as to be branched from the first fluid passage and connected to the second switching valve, a second bypass passage is formed so as to be branched from the second fluid passage and connected to the second switching valve, and the second switching valve is switchable to a first position at which the fluid is supplied to the first switching valve and the third fluid passage and the first and second bypass passages are interrupted and is switchable to a second position at which the connecting passage is interrupted and the fluid is discharged from the third fluid passage and the first and second bypass passages.

6. The valve timing control apparatus according to claim 5, wherein the second switching valve is switchable to a third position at which the fluid is supplied to the first switching valve via the check valve, the fluid is discharged from the third fluid passage, and the first bypass passage and the second bypass passage are interrupted.

7. The valve timing control apparatus according to claim 1, wherein the lock mechanism includes a retracting groove formed at the outer rotor, a regulating member housed in the retracting groove and being biased toward an outer circumferential surface of the inner rotor and a receiving groove formed at the inner rotor and to which the regulating member is inserted when a rotational phase of the inner rotor corresponds to a rotational phase of the outer rotor at a predetermined phase.

8. The valve timing control apparatus according to claim 7, wherein the third fluid passage is used for supplying the fluid to the receiving groove in order to move the regulating member from the receiving groove so as to be retracted in the retracting groove in order to establish an unlocked state, and the third fluid passage is used for discharging the fluid in the receiving groove so that the regulating member is moved so as to be inserted into the receiving groove in order to establish a locked state.

* * * * *